United States Patent [19]

Beck

[11] Patent Number: 4,848,612

[45] Date of Patent: Jul. 18, 1989

[54] HINGED DISPENSING CLOSURE

[75] Inventor: James M. Beck, Carol Stream, Ill.

[73] Assignee: Creative Packaging Corp., Wheeling, Ill.

[21] Appl. No.: 275,271

[22] Filed: Nov. 23, 1988

Related U.S. Application Data

[63] Continuation-in-part of Ser. No. 162,066, Feb. 29, 1988, Pat. No. 4,793,502.

[51] Int. Cl.[4] ..... B65D 43/14

[52] U.S. Cl. ..... 215/235; 220/339; 222/517

[58] Field of Search ..... 215/235, 237; 220/335, 220/339; 16/225, 227; 222/498, 517

[56] References Cited

U.S. PATENT DOCUMENTS 4,386,714 6/1983 Roberto et al. ..... 220/339

4,487,324 12/1984 Ostrowsky ..... 215/235 X

*Primary Examiner*—Donald F. Norton

*Attorney, Agent, or Firm*—Silverman, Cass, Singer & Winburn, Ltd.

[57] ABSTRACT

An improved reinforced snap open hinged dispensing closure for a dispensing container. The closure having the snap open feature such that the closure lid is retained in an open position away from the dispensing opening of the container. The closure lid has a pair of hinges and a central tapered hinge strap formed therebetween. The hinge strap includes at least one reinforcing rib joining the hinge strap to the closure to improve the durability thereof.

20 Claims, 3 Drawing Sheets

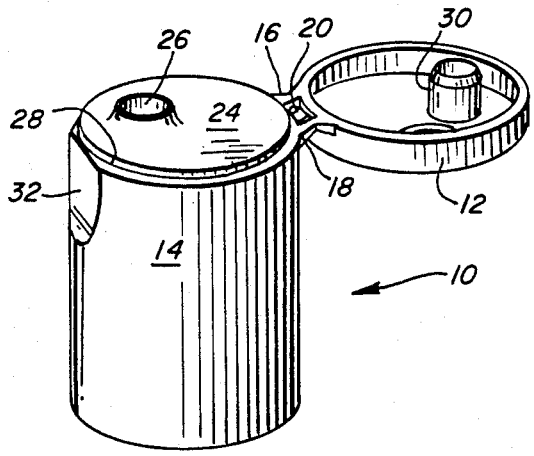
FIG. 1
FIG. 2
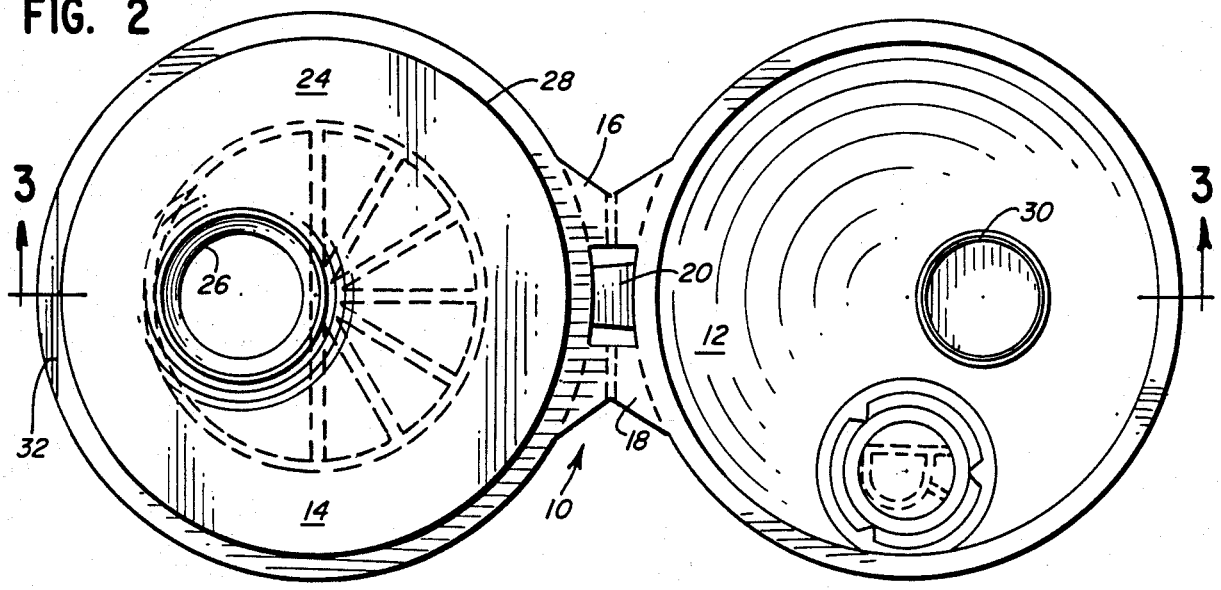
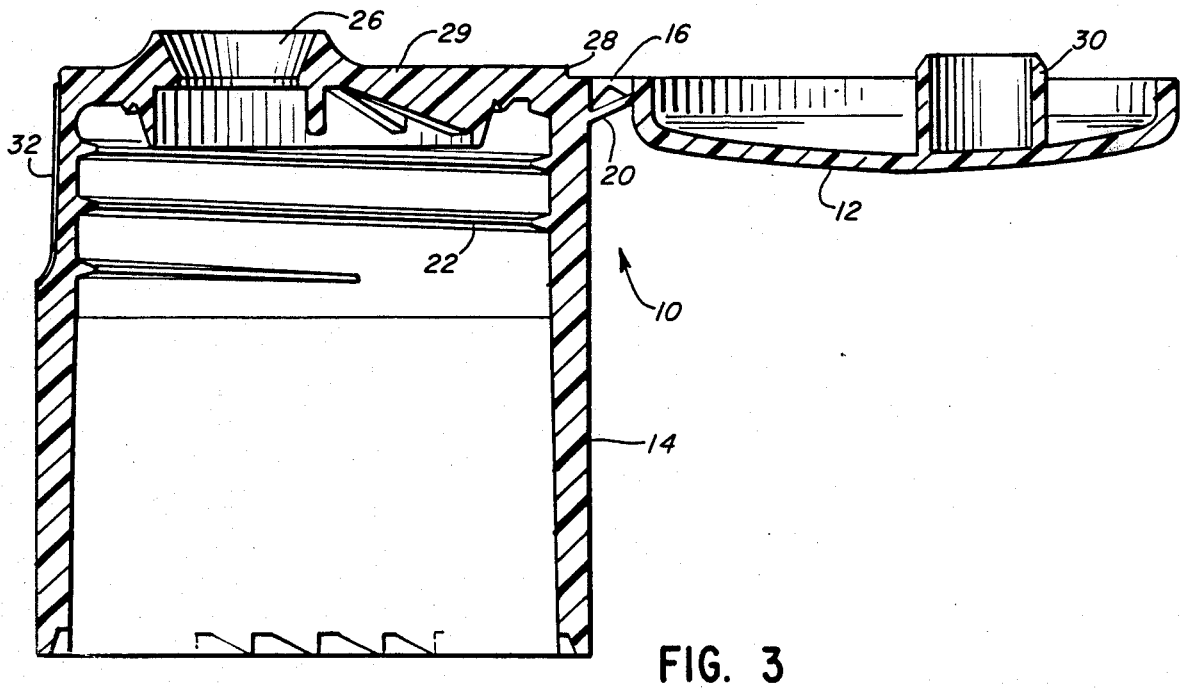
FIG. 3

FIG. 4
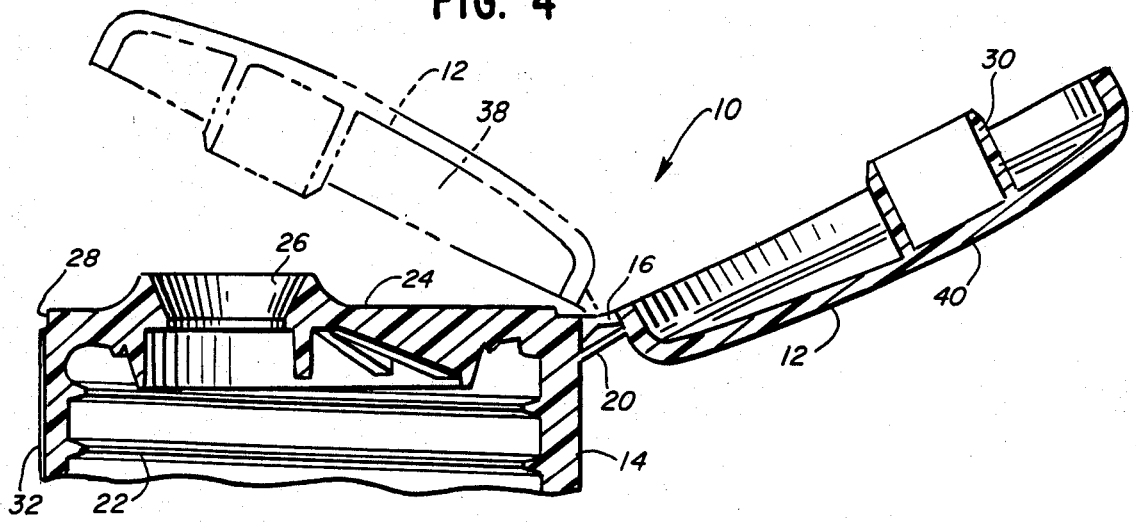
FIG. 5
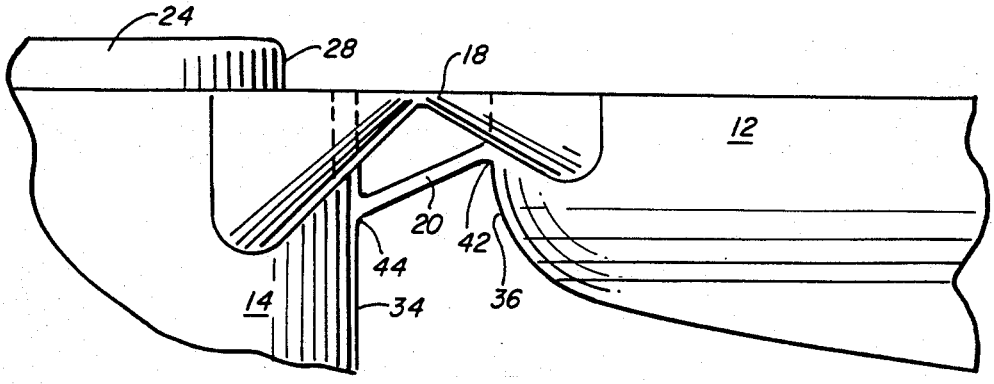
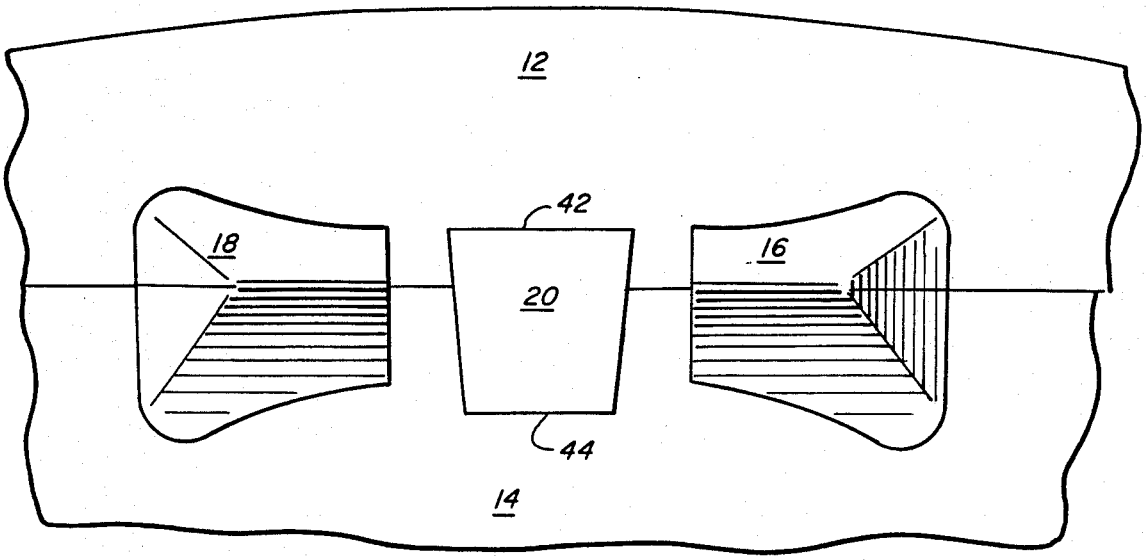
FIG. 6

HINGED DISPENSING CLOSURE

CROSS-REFERENCE TO RELATED APPLICATION

This application is a continuation-in-part of U.S. Ser. No. 07/162,066, filed Feb. 29, 1988, now U.S. Pat. No. 4,793,502, the disclosure of which is incorporated herein by reference.

BACKGROUND OF THE INVENTION

The invention relates generally to a hinged dispensing closure for a dispensing container and more particularly to an improved reinforced snap open type closure lid which snaps open and holds the closure lid away from the dispensing opening.

Dispensing containers frequently have one of two types of closures. Originally dispensing closures primarily utilized closures employing spouts mounted so as to be capable of being moved between open and closed positions. A second type of closure has a pivotally mounted lid capable of being moved between a closed and an open dispensing position. In the closed position, the lid covers the dispensing opening and in the open position, the lid is moved away from the opening to allow the product in the container to be dispensed.

A particularly useful type of pivotally mounted lid includes a mechanism to maintain the lid in the closed or open position without an outside retaining or restraining force. The lid generally is secured in the closed position, such as by a friction type fit onto the closure and is maintained in the open position away from the dispensing opening by a second mechanism, such as a snap open type hinge.

It would be desirable to provide a closure with a snap open type lid or cap which is integrally formed with the closure and is formed with a minimum of parts and having a non-complex structure and a positive snap action. Further, such structure should be durable to provide a long life for the hinge mechanism.

SUMMARY OF THE INVENTION

The above and other disadvantages of prior art dispensing closures are overcome in accordance with the present invention by providing an improved reinforced snap open hinged dispensing closure. The closure has a hinged lid which is retained in the open position by the snap open structure. The snap open structure includes a pair of hinges and a central tapered hinge strap integrally formed with the closure and lid between the hinges. The hinge strap is reinforced by at least one upraised reinforcing rib joining the hinge strap to one of the closure and lid.

BRIEF DESCRIPTION OF THE DRAWINGS

FIGS. 1–6 illustrate embodiments of the parent application, Ser. No. 07/162,066;

FIG. 1 is a perspective view of one embodiment of a hinged dispensing closure of the parent application;

FIG. 2 is a top plan view of the closure of FIG. 1;

FIG. 3 is a side sectional view of the closure of FIG. 2 taken along the line 3—3 thereof;

FIG. 4 is a side sectional view of the closure similar to FIG. 3 illustrating the snap open operation of the closure;

FIG. 5 is a partial side view of the closure of the parent application as molded;

FIG. 6 is a rear side plan view of the closure of the parent application in a fully closed position;

FIG. 7 is a partial side sectional view of one embodiment of the improved hinged dispensing closure of the invention; and FIG. 8 is a partial top plan view of the closure of FIG. 7.

DESCRIPTION OF THE PREFERRED EMBODIMENTS

Figure 7:
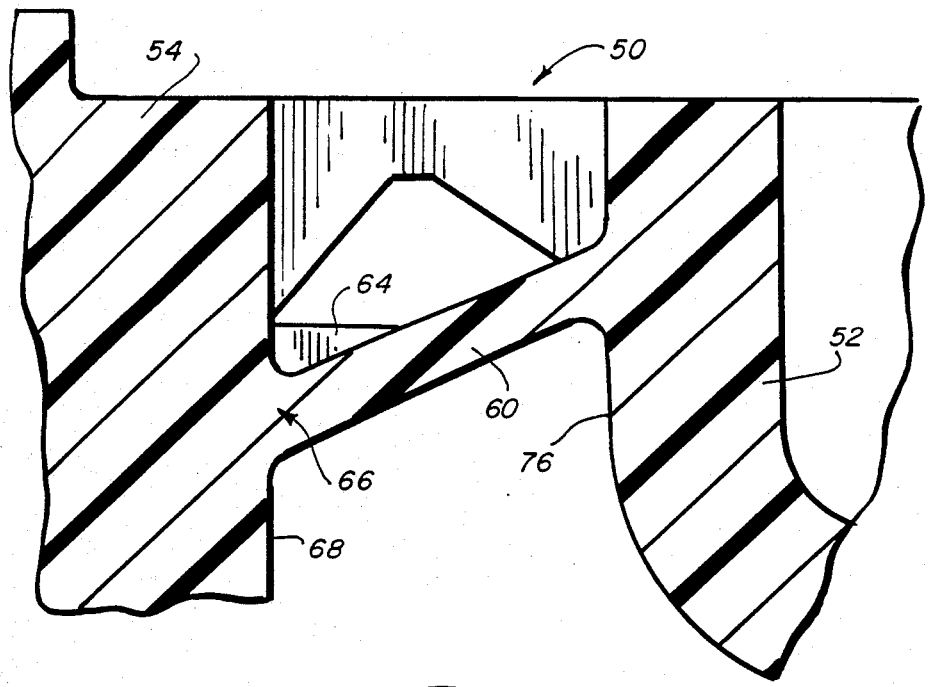
FIGS. 7 and 8 illustrate the embodiments of the present invention.

FIGS. 1–6 illustrate embodiments of the parent application, Ser. No. 07/162,066, as follows.

Referring to FIGS. 1–3, one embodiment of a hinged dispensing closure of the parent application is designated generally by the reference numeral 10. The closure 10 includes a hinged lid 12 and a cap body 14, preferably formed in one piece, such as by molding, from a strong resilient plastic, such as polypropylene. The lid 12 includes a pair of hinges 16, 18 and a central tapered hinge strap 20 therebetween to provide the snap open feature and which will be further described with respect to FIGS. 4–6.

As best illustrated in FIG. 3, the cap body 14 includes inner threads 22 to allow the closure 10 to be secured to a dispensing container (not illustrated). The body 14 includes an upper wall or top 24 which includes a dispensing opening 26 therethrough. FIGS. 1–3 illustrate the closure in the open, just molded position. In the closed position, the lid 12 snaps shut over a peripheral edge 28 of the top 24. The lid 12 includes a plugging structure 30 which depends from the inside thereof to mate with the inside of the opening 26 to close the opening when the lid 12 is closed. The body 14 also includes a partial facet 32 along an edge opposite the hinges 16, 18 to allow the lid 12 easily to be opened.

Referring now to FIGS. 4–6, the operation of the closure 10 and the construction of the hinges 16 and 18 and the hinge strap 20 are best illustrated. When the closure 10 is first formed, the body 14 and the lid 12 are aligned with the lid substantially parallel with the top 24 of the body 14, as illustrated in FIG. 5 (and in FIGS. 1–3). The hinge strap 20 is formed attached at an angle to a side wall 34 of the body 14 and to a side wall 36 of the lid 12. The angle can be reversed if desired. When the closure 10 is utilized, the hinge strap 20 is slightly stretched, resulting in two open positions, as illustrated in FIG. 4.

The lid 12 when closed, snap fits over the edge 28, in a conventional manner which is not illustrated. When the lid 12 is pushed or pried open by exerting a force on the lid 12 at the top of the facet 32, the lid 12 assumes a first open position 38, illustrated in phantom. Clearly, the dispensing opening 26 is still somewhat blocked by the lid 12 in this first open position. By exerting a force to move the lid 12 substantially to or slightly beyond a perpendicular angle with the top 24, the hinge strap 20 causes the lid 12 to snap open into a second fully open position 40. The lid 12 is retained in this position by the action of the hinge strap 20 until it is desired to close the lid 12 in which case the opposite operation is performed to snap the lid 12 shut onto the top 24 of the body 14, as illustrated in FIG. 6.

The formation of the hinge strap 20 is crucial to the proper snap open operation of the closure 10. The closure 10 first was designed with the hinge strap formed parallel to the top 24 of the body 14 (perpendicular to the side walls 34 and 36), but this structure did not provide sufficient length for the hinge strap 20 to provide a proper snap action. The hinge strap 20 also could snap, making the closure 10 inoperative. The closure 10 preferably is operable for a large number of operations of opening and closing the lid 12, hence the operating life of the hinge strap 20 is critical.

The hinge strap 20 (best illustrated in FIG. 6) is formed with a tapered body having a first side 42 with a width wider than a second side 44. The side 44 is shown attached to the side wall 34, but the taper can be reversed with the wider side 42 attached to the side wall 34. The taper can be at an angle about 15% from a parallel sided strap. The hinge strap 20 in one specific embodiment has a width at the side 42 of 0.200 inches with the width of the hinge connections of the hinges 16 and 18 being about 0.035 inches. The hinge strap 20 has a thickness on the order of 0.006 to 0.011 inches. In this example, the closure 10 has a diameter of 1.070 inches.

The hinge strap 20 and the hinges 16 and 18 thus formed provide a non-complex snap open hinge structure, which also has a long operating life. The relative dimensions, of course, would be changed to accommodate different sized closures. The length of the hinge strap 20 varies with the specific application of the angle of the strap 20 and the distance below the top edge of the lid 12 and hinges 16, 18 varied to obtain the desired snap action.

Figure 8:
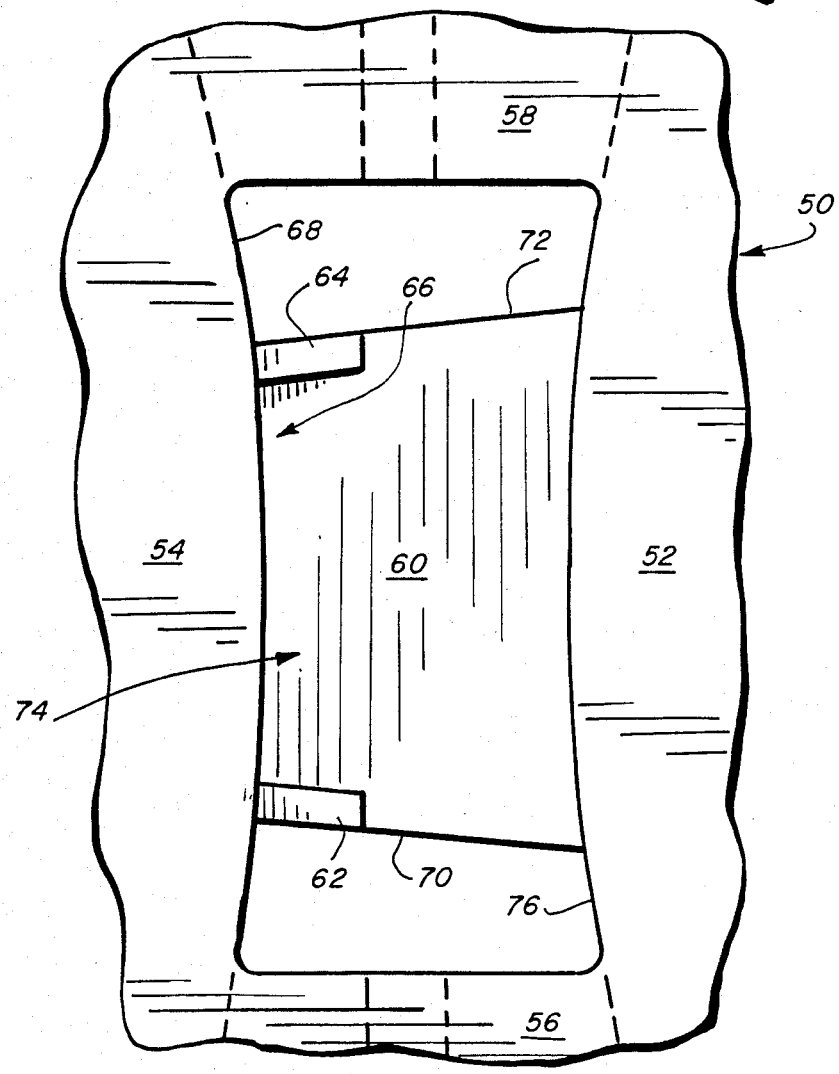

Referring now to FIGS. 7 and 8, one embodiment of an improved reinforced hinged dispensing closure of the invention is designated generally by the reference numeral 50. As before, the closure 50 includes a hinged lid 52 and a cap body 54, partially illustrated, which can be essentially identical to the lid 12 and the cap body 14. Also, as before, the lid 52 includes a pair of hinges 56 and 58 and a central tapered hinge strap 60 therebetween to provide the snap open feature, in the same manner as the hinges 16 and 18 and hinge strap 20.

It has been discovered by Applicant that the hinge strap 20 in some cases can weaken and break, causing the closure 10 to become partially or wholly inoperative. The breakage or failure generally appeared to be at the most narrow width of the strap 20. It therefore would be desirable to reinforce the hinge strap 20 or 60 to increase the durability of the closures 10 or 50. One attempted option was to increase the thickness of the strap 20 at the most narrow width, the side 44 as illustrated, however, this did not appear to be effective.

Applicant accomplished the desired improved durability of the hinge strap 60 by providing at least one, and preferably a pair, of reinforcing ribs 62 and 64 adjacent a narrow end 66 of the tapered strap 60. The rib or ribs 62 and 64 preferably are tapered from a point on the strap 60 to a point on a side wall 68 of the body 54. The rib or ribs 62 and 64 thus have a substantially triangular side profile as illustrated in FIG. 7. The rib or ribs 62 and 64 provide the desired reinforcement of the strap to improve the durability of the hinge closure 50. Further, although two straps 62 and 64 are formed adjacent the outer edges 70 and 72 of the strap 60, the single strap (not illustrated) could be provided in the center area 74 of the strap 60. Further, a third rib could also be provided centrally between the two outer ribs 62 and 64, if desired (also not illustrated).

Again, as described with respect to the strap 20, the narrow tapered width 66 of the strap 60 can be provided either at the side wall 68 of the body 54 or oppositely at a side wall 76 of the lid 52. Further, although the length of the rib or ribs 62, 64 is illustrated as about one-half the length of the strap 60, the length is not critical and can be from about one-third to substantially the whole length of the strap 60.

Modifications and variations of the parent application are possible in light of the above teachings. It is therefore to be understood that within the scope of the appended claims, the parent application may be practiced otherwise than as specifically described.

What is claimed and desired to be secured by Letters Patent of the United States is:

1. An improved closure with a reinforced snap type hinge cap, comprising:

a cap body portion adapted to be secured to a container;

a lid hinged to said cap body by a pair of spaced apart hinges integrally formed between said cap body and said lid; and a tapered hinge strap integrally formed between said cap body and said lid between said pair of hinges, including at least one reinforcing rib joining said hinge strap to one of said cap body and said lid.

2. The improved closure as defined in claim 1 wherein said tapered hinge strap has a width on a side attached to said cap body greater than the width attached to said lid.

3. The improved closure as defined in claim 1 wherein said tapered hinge strap has a width on a side attached to said lid greater than the width attached to said cap body.

4. The improved closure as defined in claim 1 wherein said hinge strap is attached at an angle to said cap body and to said lid.

5. The improved closure as defined in claim 4 wherein said cap body has an upper free edge and said lid has an upper free edge and said hinges have an upper edge formed substantially aligned with said lid and said cap body free edges.

6. The improved closure as defined in claim 5 wherein said cap body and said lid have side walls opposed to one another and said hinge strap is attached to said cap body and to said lid on said side walls below said free edges.

7. The improved closure as defined in claim 6 wherein said hinge strap is attached to said cap body side wall at a greater distance from said free edges than said hinge strap is attached to said lid side wall.

8. The improved closure as defined in claim 6 wherein said hinge strap is attached to said lid side wall at a greater distance from said free edges than said hinge strap is attached to said cap body side wall.

9. The improved closure as defined in claim 1 including said rib being integrally formed in an upstanding triangular shape joining at least a portion of said strap to one of said cap body and said lid.

10. The improved closure as defined in claim 1 including at least a pair of reinforcing ribs integrally formed with said hinge strap adjacent each edge thereof and to one of said cap body and said lid.

11. The improved closure as defined in claim 1 wherein said hinge strap is substantially planar and has a width at one end adjacent one of said cap body and said lid greater than the width at a second end thereof and said rib is formed adjacent the narrow width of said hinge strap.

12. An improved closure with a reinforced snap type hinge eap, comprising:

a cap body portion adapted to be secured to a container;

a lid hinged to said cap body by a pair of spaced apart hinges integrally formed between said cap body and said lid;

said cap body having an upper free edge and said lid having an upper free edge and said hinges having an upper edge formed substantially aligned with said lid and said cap body free edges; and a tapered hinge strap integrally formed between said cap body and said lid between said pair of hinges, said hinge strap being attached at an angle to said cap body and to said lid and including at least one reinforcing rib joining said hinge strap to one of said cap body and said lid.

13. The improved closure as defined in claim 12 wherein said tapered hinge strap has a width on a side attached to said cap body greater than the width attached to said lid.

14. The improved closure as defined in claim 12 wherein said tapered hinge strap has a width on a side attached to said lid greater than the width attached to said cap body.

15. The improved closure as defined in claim 12 wherein said cap body and said lid have side walls opposed to one another and said hinge strap is attached to said cap body and to said lid on said side walls below said free edges.

16. The improved closure as defined in claim 15 wherein said hinge strap is attached to said cap body side wall at a greater distance from said free edges than said hinge strap is attached to said lid side wall.

17. The improved closure as defined in claim 15 wherein said hinge strap is attached to said lid side wall at a greater distance from said free edges than said hinge strap is attached to said cap body side wall.

18. The improved closure as defined in claim 12 including at least a pair of reinforcing ribs integrally formed with said hinge strap adjacent each edge thereof and to one of said cap body and said lid.

19. The improved closure as defined in claim 12 including said rib being integrally formed in an upstanding triangular shape joining at least a portion of said strap to one of said cap body and said lid.

20. The improved closure as defined in claim 12 wherein said hinge strap is substantially planar and has a width at one end adjacent one of said cap body and said lid greater than the width at a second end thereof and said rib is formed adjacent the narrow width of said hinge strap.

* * * * *